US006098701A

United States Patent [19]

Blomgren

[11] Patent Number: 6,098,701

[45] Date of Patent: Aug. 8, 2000

[54] PLATE HEAT EXCHANGER

[75] Inventor: Ralf Erik Blomgren, Skanör, Sweden

[73] Assignee: Alfa Laval AB, Lund, Sweden

[21] Appl. No.: 09/043,621

[22] PCT Filed: Sep. 24, 1996

[86] PCT No.: PCT/SE96/01192

§ 371 Date: Mar. 24, 1998

§ 102(e) Date: Mar. 24, 1998

[87] PCT Pub. No.: WO97/12189

PCT Pub. Date: Apr. 3, 1997

[30] Foreign Application Priority Data

Sep. 26, 1995 [SE] Sweden ..... 9503241

[51] Int. Cl.[7] ..... F28F 9/00

[52] U.S. Cl. ..... 165/67; 165/76; 165/167; 165/906

[58] Field of Search ..... 165/166, 167, 165/906, 67, 76

[56] References Cited

U.S. PATENT DOCUMENTS

| | | | |
|---|---|---|---|
| 1,925,475 | 9/1933 | Albohr | 165/67 |
| 2,428,880 | 10/1947 | Kintner . | |
| 3,385,353 | 5/1968 | Straniti et al. | 165/67 |
| 3,540,531 | 11/1970 | Becker . | |
| 3,568,765 | 3/1971 | Konrad | 165/166 |

FOREIGN PATENT DOCUMENTS

| | | |
|---|---|---|
| 62-186 | 3/1987 | Japan . |
| 62-187 | 3/1987 | Japan . |
| 413695 | 6/1980 | Sweden . |
| 2151347 | 7/1985 | United Kingdom . |

*Primary Examiner*—Leonard Leo
*Attorney, Agent, or Firm*—Fish & Richardson, P.C.

[57] ABSTRACT

A plate heat exchanger (1) comprises a stack of heat transfer plates (2) provided between two end pieces (3, 4) and each having an essentially plane extension. Each end piece (3, 4) has an inner surface (9) facing said heat transfer plates and an outer surface (14) facing away from said heat transfer plates (2) and extending from one side to another of the end piece (3, 4). The plate heat exchanger (1) is compressed by means of at least one member (18) extending around the plate heat exchanger and abutting said outer surface (14) of each end piece (3, 4) in order to prevent the retreat of the end pieces from each other. The outer surface (14) of each end piece (3, 4) is curved in such a manner that the end piece has a convex shape in a cross section along a first plane (Y, Z) being perpendicular to the essentially plane extension of the heat transfer plate (2).

17 Claims, 5 Drawing Sheets

PLATE HEAT EXCHANGER

TECHNICAL FIELD OF THE INVENTION AND PRIOR ART

The present invention refers to a plate heat exchanger comprising a stack of heat transfer plates provided between two end pieces and each having an essentially plane extension, each end piece having an inner surface facing said heat transfer plates and an outer surface facing away from said heat transfer plates and extending from one side to another of the end piece, the plate heat exchanger being compressed by means of at least one member extending around the end pieces and the heat transfer plates in such a manner that said member abuts said outer surface of each end piece in order to prevent the retreat of the end pieces from each other.

A conventional plate heat exchanger comprises a stack of heat transfer plates being compressed between two end pieces or end plates by means of two or more bolts or tightening bars. The bolts extend between holes extending through the end plates in their outer regions and outside the stack of heat transfer plates compressed between the end plates. The internal pressure of the heat exchanger acts on the end plates and since the bolts are located outside the pressure-loaded surface of the end plates, there are large bending stresses in the end plates, which may result in a considerable deflection of the end plates. Such a deflection leads to a play in the plate stack, which in turn influences the thermal performance and, to a certain degree, also the fatigue strength of the plates. To compensate for this it is necessary to use end plates having a significant thickness of material already by relatively moderate working pressures. Consequently, the plate heat exchanger becomes heavy and the manufacturing cost is relatively high.

JP-A-62 062 186 discloses a plate heat exchanger of the initially defined type, comprising a stack of heat transfer plates provided between two end plates. Each end plate comprises a planar inner surface, facing the heat transfer plates, a planar outer surface, and edge surfaces connecting the inner and outer surfaces. A compressing member in the form of a belt-type thin sheet extends around the plate heat exchanger. Said sheet is sharply bent around the corners formed by the outer surface and the edge surfaces. Due to this sharply bent corners the inherent stresses in the compressing are not negligible. Moreover, bending stresses will exist in the end plates, resulting in a deflection of the end plates in a central portion thereof. Consequently, the plate heat exchanger disclosed in JP-A-62 062 186 is not able to withstand high internal pressures.

In comparison to this Japanese prior art, JP-A-62 062 187 discloses a somewhat modified plate heat exchanger comprising longitudinal ribs provided on the outer surface of the end plates. The thin sheet of the compressing member extends around the plate heat exchanger and abuts a straight edge surface of the ribs in such a manner that the thin sheet is bent around the ribs. As in JP-A-62 062 186, the thin sheet is sharply bent around the corners of the end plates.

SE-B-343 383 discloses a plate heat exchanger having a stack of heat transfer plates provided between two end pieces, each end piece comprising a curved outer surface facing away from the heat transfer plates and a plane inner surface facing the heat transfer plates. The curved outer surface has a dome-like shape, i.e. it is curved in all directions. Furthermore, each end piece is provided with a circumferentially extending flange having holes through which tightening bolts extend for keeping together the plate heat exchanger stack. In addition, one of the end pieces comprises a plate forming the plane inner surface and being hydraulically movable against the heat transfer plates in order to press these together.

SE-B-413 695 discloses packages of heat exchanger plates, said packages being intended to be placed in chambers of rotating heat exchangers. The heat exchanger packages are temporarily compressed by a band for facilitating the insertion of the packages in the chambers. When the heat exchanger packages are positioned in the rotating heat exchanger the bands are cut and the packages are allowed to expand in radial direction in the chambers. Thus, the bands are not suitable for compressing the heat exchanger package when it is subjected to the pressure of the flowing medium.

GB-A-2 151 347 discloses a plate heat exchanger with a plurality of heat transfer plates being enclosed between a base and a closure member integrally connected to the base by side walls to form a circumferential frame. A movable plate is insertable between the closure member and the heat transfer plates. The heat transfer plates are pressed against each other by moving the movable plate from the closure member by means of tightening screws in the direction of the base.

SUMMARY OF THE INVENTION

The object of the present invention is to provide a plate heat exchanger which is compressed in such a manner that the bending stresses in the end pieces may be reduced. This object is obtained by the plate heat exchanger initially defined and characterized in that said outer surface of each end piece is curved in such a manner that the end piece has a convex shape in a cross-section along a first plane crossing said sides and being perpendicular to the essentially plane extension of the heat transfer plate. Due to such a curved outer surface of the end pieces, the circumferentially extending compressing member may effectively resist the internal pressure forces. By means of the compressing member according to the present invention, the internal pressure in the heat exchanger is transferred to the curved end pieces as uniformly distributed pressure stresses. Thereby, no significant bending moment will occur and no significant deflection of the end pieces will take place. The end pieces essentially function as distance members and consequently may be manufactured in a material with lower strength than required according to the prior art.

According to an embodiment of the present invention, said outer surface of each end piece is continuously curved from said one side to another. Such a continues curvature enables minimizing of the stresses in the end pieces.

According to a further embodiment of the present invention, the curved outer surface in the proximity of an edge between said inner surface and said outer surface is shaped in such a manner that a tangential plane of said outer surface is essentially perpendicular to the essentially plane extension of the heat transfer plate. In such a way, a sharp bending of the compressing member is avoided, which otherwise might have resulted in bending stresses in the end pieces, or in strength problems of the compressing member.

According to a further embodiment of the present invention, the compressing member comprises joining means provided to releasably tighten the compressing member around the end pieces and the heat transfer plates. Furthermore, said joining means may be provided to enable adjustment of the compressing force of the compressing member.

According to a further embodiment of the present invention, the compressing member comprises at least one wire-, bar-, band- or plate-like member extending around the end pieces and the heat transfer plates. Thereby, the compressing member may comprise at least one bolt extending in a loop in such a manner that it is closely abutting at least one of the curved outer surfaces of the end pieces. Furthermore, the compressing member may comprise at least a pair of curved bolts mutually connected to a loop and each being curved in such a way that they are closely abutting the curved outer surface of a respective end piece in a common plane. Advantageously, the joining means may comprise a nut having a right-handed thread and a left-handed thread and being screwed onto opposite bolt ends. Alternatively, the compressing member may comprise a wire being wound in a helical coil about the end pieces and the heat transfer plates. Advantageously, the helical wire coil is wound in such a way that each round of the wire is abutting the adjoining wire round. According to still a further alternative, the compressing member comprises a plate which extends around the end pieces and the heat transfer plates. Such a plate may for instance have the same width as the plate heat exchanger. Moreover, the plate may be divided in two parts, each part may extend around a respective end piece in such a way that each end edge of one part is adjacent to an end edge of the other part, and adjacent end edges of the parts may be joined to each other by the joining means.

According to a further embodiment of the present invention, each end piece comprises a plane plate forming said inner surface. Thereby, each end piece may comprise a support plate disposed on the plane plate and having a curved edge surface. Advantageously, the support plate extends essentially perpendicularly to the plane plate. Moreover, several such support plates may be provided and spaced from each other, and a further support plate may extend essentially perpendicular to the support plates in order to support the support plates in the lateral direction.

According to a further embodiment of the present invention, said convex shape is essentially semicircular. By a semicircular curvature of the end pieces essentially all bending stresses thereof may be eliminated.

BRIEF DESCRIPTION OF THE DRAWINGS

The present invention will now be explained more closely by means of different embodiments disclosed in the drawings attached hereto.

DETAILED DESCRIPTION OF DIFFERENT EMBODIMENTS

Figure 1:
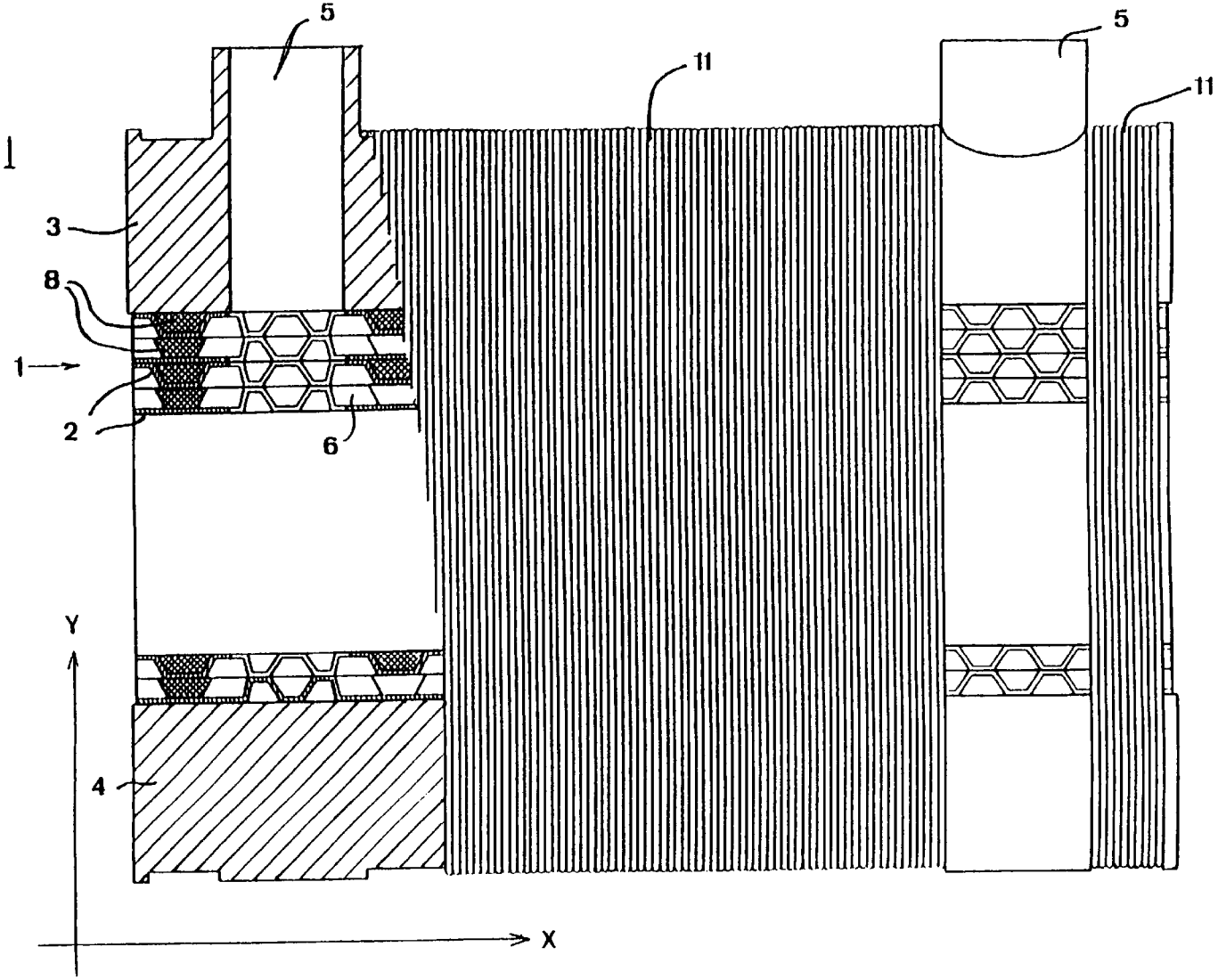
FIG. 1 is a sectional view through a heat exchanger according to a first embodiment.

FIG. 1 discloses a first embodiment of a plate heat exchanger 1 according to the present invention. The plate heat exchanger 1 comprises a stack of heat transfer plates 2 being corrugated and compressed against each other between two end pieces 3 and 4. One 3 of the end pieces comprises inlet and outlet means 5 for a first and second, respectively, medium carried through channels 6 and 7, one for each medium, and formed between the heat transfer plates 2. For sealing off the channels 6 and 7 gaskets 8, preferably of rubber, are provided therebetween. It should be noted, however, that the channels 6, 7 may be permanently sealed off as well by any suitable method, such as welding, brazing, gluing or the like. Moreover, the heat transfer plates 2 may be permanently fixed together in pairs, such pairs then being arranged in said heat transfer plate stack. Each heat transfer plate 2 has an essentially plane extension in a longitudinal direction X and a direction Z orthogonal to the direction X, and a small height in a direction Y in relations to the plane extension. Each heat transfer plate 2 has a normal with respect to the essentially plane extension and the heat transfer plates 2 are arranged in such a way that their normals are essentially parallel.

Figure 2:
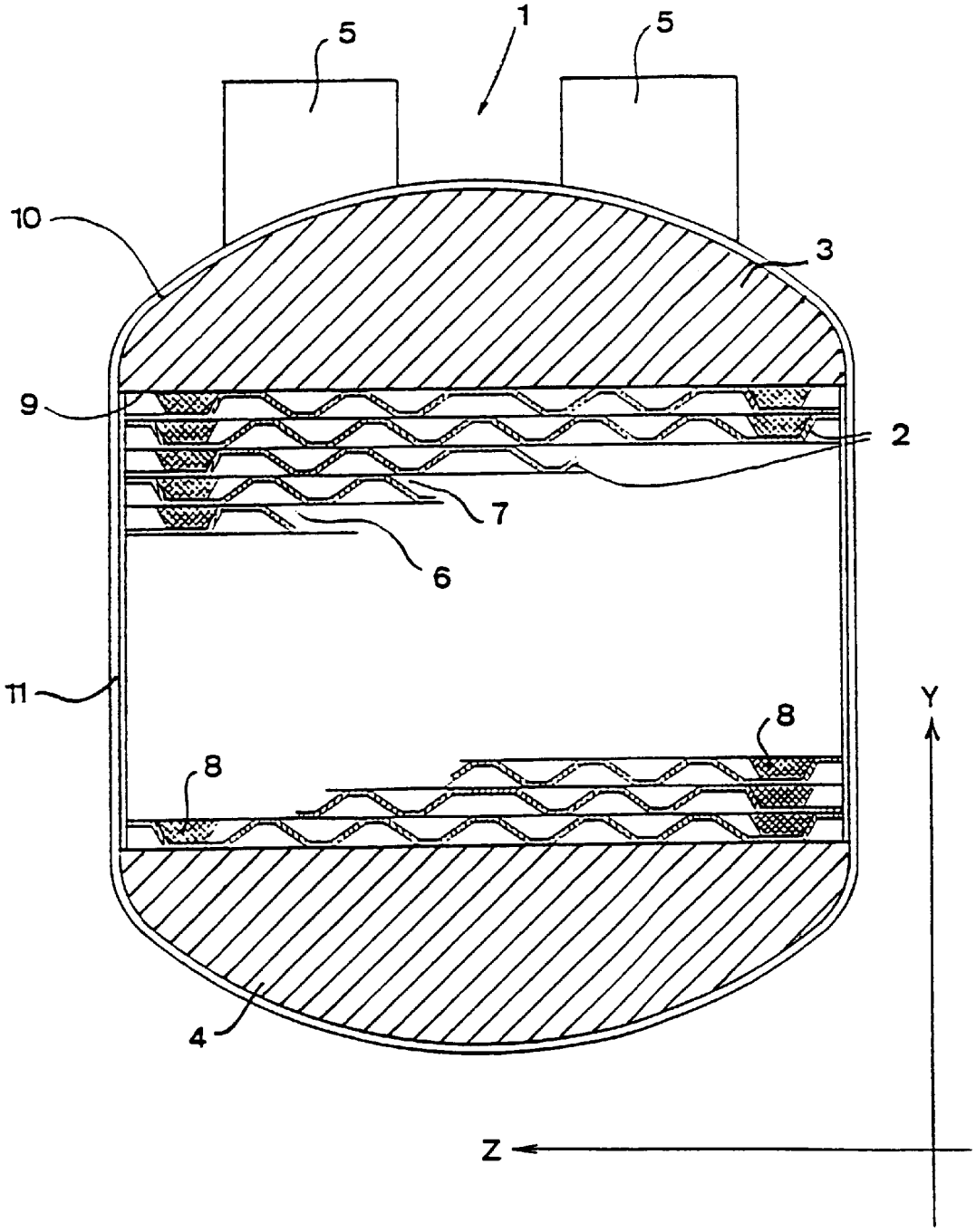
FIG. 2 is another sectional view through the heat exchanger.
Figure 4:
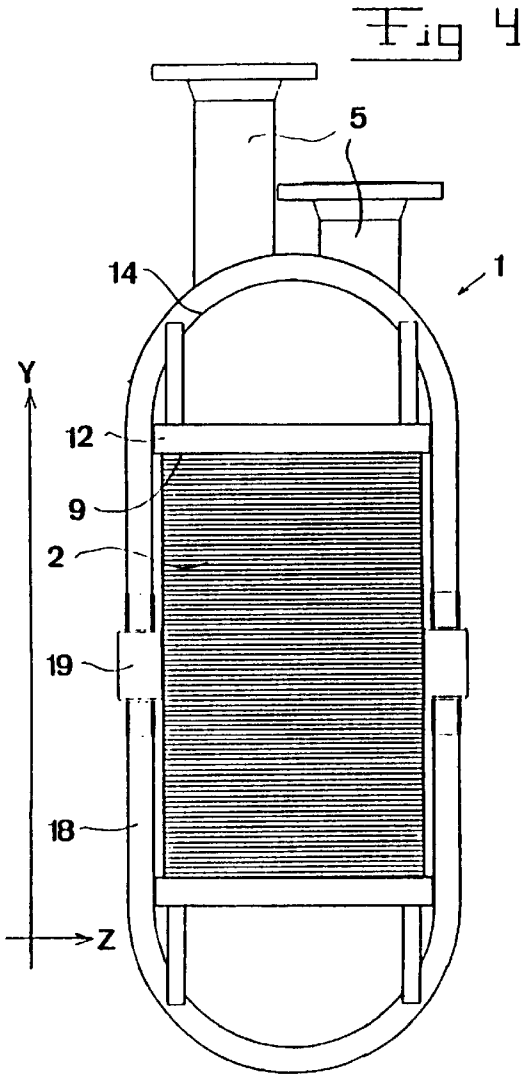
FIG. 4 is another side-view of the heat exchanger in FIG. 3.
Figure 3:
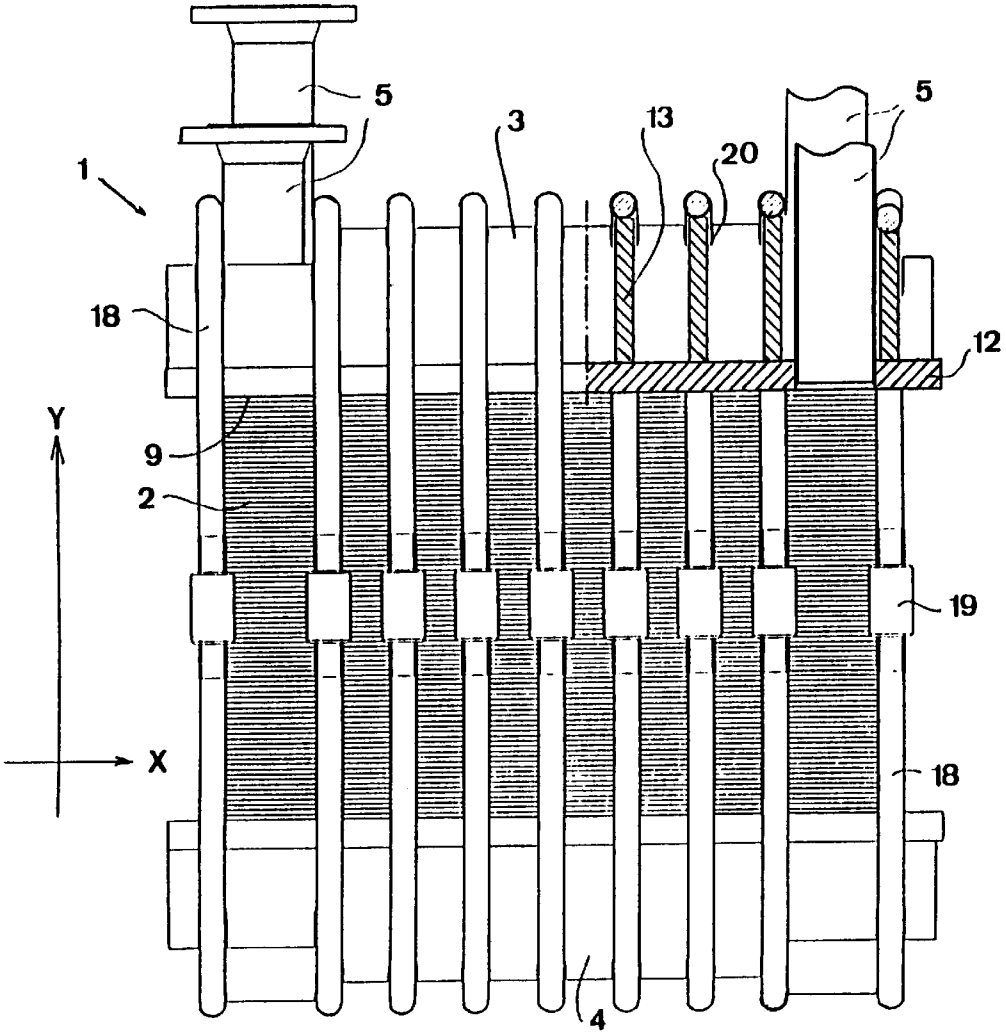
FIG. 3 is a partly sectional side-view of the heat exchanger according to a second embodiment.
Figures 5, 6:
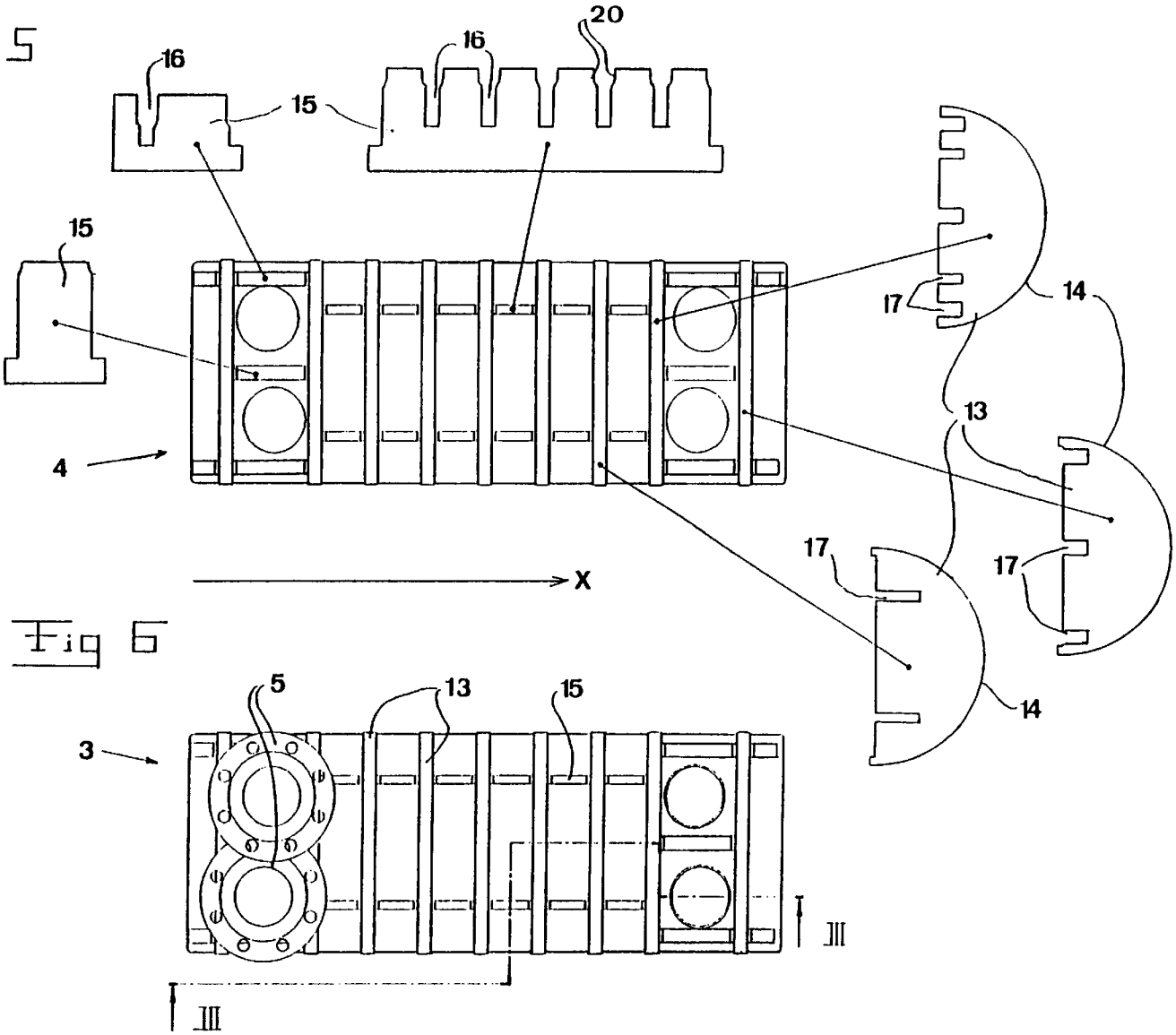
FIG. 5 is a view from beneath of a plate heat exchanger in FIG. 3.
FIG. 6 is a view from above of the heat exchanger in FIG. 3.

Each end piece 3 and 4 has, as disclosed in the sectional view of FIG. 2, a plane inner surface 9 facing the heat transfer plates 2 and a curved outer surface 10 facing away from the heat transfer plates 2. The curved outer surface 10 has a convex, oval shape in a cross-section. The oval shape has no sharp corners and the curved outer surface 10 is, in the proximity of an edge between the inner surface 9 and the outer surface 10, i.e. at the junction to the plane inner surface 9, perpendicular to the essentially plane extension of the heat transfer plate 2, i.e. extends in the height direction Y. It should be noted that also other curved surface shapes are suitable, for instance semicircular or elliptic.

In order to compress the plate heat exchanger 1 a flexible, bendable compressing member, in the example disclosed a wire 11, is wound around the end pieces 3 and 4 and the heat transfer plates 2 lying therebetween. Preferably, the wire 11 is manufactured in a material of high strength. The wire 11 is wound as a helical coil around the end pieces 3, 4 and the heat transfer plates 2 in such a manner that each round of the wire 11 is closely abutting the adjoining wire round. The wire 11 is tightly wound along the complete length of the plate heat exchanger 1, one end of the wire 11 being fixed to one of the end pieces 3, 4, and the other end of the wire 11 being fixed to one of the end pieces 3, 4. Due to the curved shape of the end pieces 3 and 4 no essential bending stresses will occur therein but mainly pressure stresses. Said pressure stresses will be transferred to the wire 11 as a tensile stress therein. In order to be able to resist the pressure stresses the end pieces 3 and 4 disclosed may be provided in a solid material, for instance a plastic material, such as PVC. Furthermore, the solid material may be concrete or moulded aluminium. Also other materials may be used. It should be noted that the plate heat exchanger 1 according to the first embodiment also may be provided with end pieces 3, 4 having a construction other than a solid body. For instance, the end pieces 3, 4 may be hollow and filled with a means resisting pressure forces, such as a liquid or support beams.

FIGS. 3–6 disclose a second embodiment of a plate heat exchanger 1 according to the present invention. It should be noted that elements having a corresponding function have the same reference signs in all embodiments disclosed. As in the first embodiment also the second embodiment comprises a stack of heat transfer plates 2. Each plate 2 has an essentially plane extension in the plane X, Z and the plates 2 are compressed against each other between two end pieces 3 and 4. One 3 of the end pieces comprises inlet and outlet means 5 for a first and second, respectively, medium carried through the plate heat exchanger 1.

Each end piece 3, 4 comprises a plane plate 12, e.g. a steel plate, forming the inner surface 9 facing the heat transfer plates 2. The inlet and outlet means 5 extend through apertures in the plane plate 12 of one of the end pieces 3. A plurality of support plates 13 are provided perpendicularly, i.e. in the direction Y, to the plane plate 12. As is disclosed in FIG. 5 each support plate 13, which may be formed by a steel plate, comprises a curved edge surface 14 facing away from the heat transfer plates 2. Thus, in a cross-section plane Y, Z each support plate 13 has a straight edge line 9 and a convex edge line 14 which e.g. may be oval, elliptic or as in the example disclosed semicircular. Further support plates 15 are provided between each support plate 13 and extending essentially perpendicular to the support plates 13. As is disclosed in FIG. 5, two such further support plates 15 are provided between the middle support plates 13 and three such further support plates 15 between the outer support plates 13. It should be noted that the number of such further support plates 15 of course may be varied and in many cases only one such further support plate 15 between each support plate 13 would be sufficient. Such further support plates 15 may be formed as individual, loose plates between each pair of support plates 13 or as a whole plate extending over several support plates 13 and being provided with a number of slits 16 extending to about half the height of the plate 15. In this case, the support plates 13 also have slits 17 extending to about half the height of the plate 13. By means of such a shape the support plates 13 may, as is disclosed in FIG. 5, be inserted in the further support plates 15 provided against the plane plate 12, in such a manner that the plates 13, 15 are locking each other in a correct position. Thereby, no further joining, such as welding, is necessary. However, the plane plate 12, the support plates 13 and the further support plates 15 may also be fixed to each other by means of any suitable joining method such as welding.

In order to compress the plate heat exchanger 1, a compressing member is tightable around the end pieces 3, 4 and the heat transfer plates 2. As is disclosed in FIGS. 3 and 4 the compressing member comprises a number of U-shaped, curved bolts 18 being provided in pairs around the plate heat exchanger 1 in such a way that the bolts 18 abut the curved edge surface 14 of the support plates 13 along their curved extension. The two bolts 18 of each pair are provided in a common plane extending in the directions Y and Z. The bolts 18 of each pair are mutually and releasably connected to each other in a closed loop by means of two tightable joining members 19 in the form of a nut having a right-handed thread and a left-handed thread. By tightening the nuts 19 the plate heat exchanger 1 may be pretightened by a desired force. Thereby, each bolt 18 may be provided with a right-handed thread and a lefthanded thread, or one of the bolts 18 of each pair may be provided with left-handed threads and the other bolt 18 of each pair with right-handed threads. To ensure that the bolt 18 is not able to slide off the edge surface 14 of the support plate 13, the further support plates 15 extend upwardly over the support plates 13 in such a way that they prevent a lateral movement of the bolt 18, see FIGS. 3 and 4. Possibly, the further support plates 15 may be provided with recesses 20 formed in the upper corners in the case that the diameter of the bolt 18 exceeds the thickness of the support plates 13. This embodiment of the compressing member may of course be combined with the other disclosed embodiments of the end pieces, such-as solid end pieces or hollow end pieces.

Figure 8:
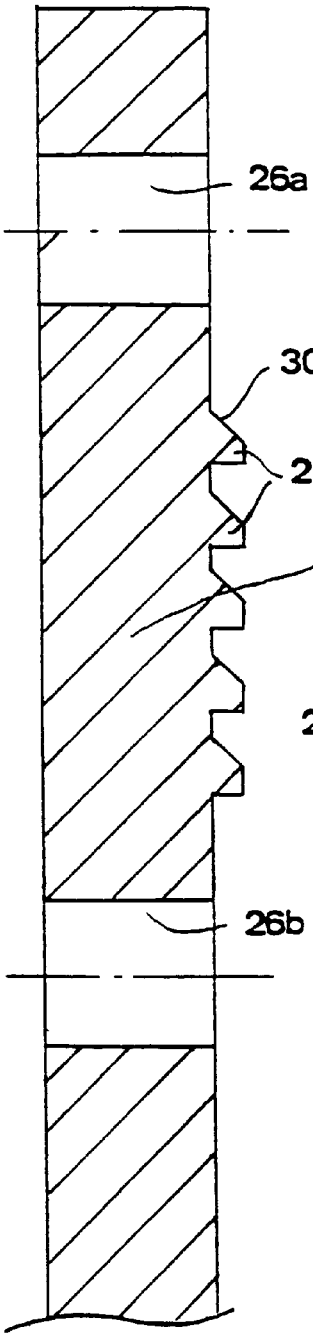
FIG. 8 is an enlarged sectional view of a detail in FIG. 7.
Figure 7:
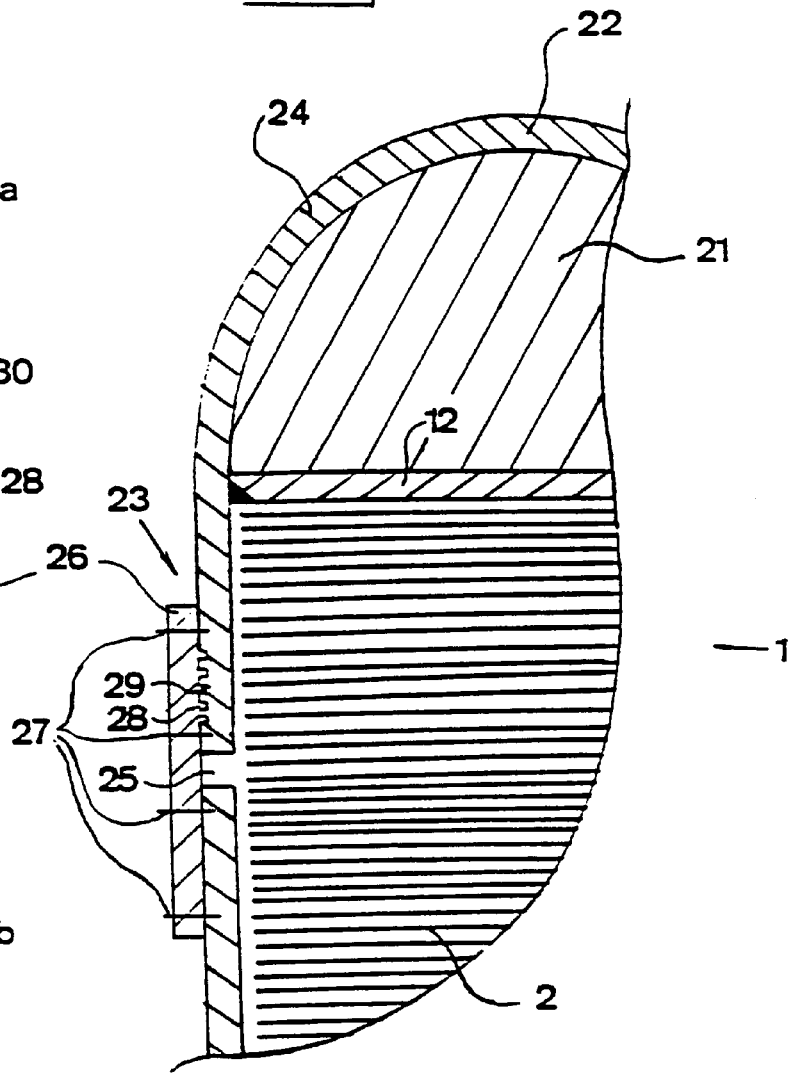
FIG. 7 is a sectional view through a further embodiment.

FIGS. 7 and 8 disclose a further embodiment of a plate heat exchanger 1 according to the present invention. The plate heat exchanger 1 comprises a number of schematically disclosed heat transfer plates 2 compressed between two end pieces 3. In FIG. 7 only one 3 of the two end pieces is disclosed. Each end piece 3 comprises a plane plate 12 abutting the heat transfer plates 2 and a curved body 21 having a convex outer surface 22. The curved body 21 may be formed of a solid body extending over the whole length X of the plate heat exchanger 1, a curved plate being fixed to the plane plate 12, or be formed of several plane plates extending perpendicularly in the direction Y from the plane plate 12 and having a convex edge surface 22. The convex shape may also in this embodiment be oval, elliptic or semicircular. The plate heat exchanger 1 is compressed by a compressing member 23 being formed as a sweep extending around the plate heat exchanger 1 and comprising at least a pair of smoothly bent plates 24 provided around a respective end piece 3 in such a way that the end edges of the bent plates 24 adjoin each other with a gap 25 therebetween. The curved body 21 may be welded to the plane plate 12 and also to the bent plate 24. Furthermore, the plane plate 12, as is disclosed in FIG. 7, may be welded to the bent plate 24. The bent plates 24 are kept together by means of at least one joining member 26 disclosed in an enlarged sectional view in FIG. 8. Preferably, at least two joining members 26 are provided, one at each side of the plate heat exchanger 1. Each joining member 26 is fixed to each bent plate 24 by means of two schematically indicated screws 27. These screws 27 may extend through holes 26*a*, 26*b* in the joining member 26 and be screwed in threaded holes in the bent plates 24. The joining member 26 comprises for each bent plate 24 one or several, in the example disclosed five, protruding ridges extending in the longitudinal direction X of the plate heat exchanger 1 and being provided to engage corresponding recesses 29 of the plates 24. Each ridge 28 and recess 29 is provided with a bevelled, inclined surface 30 to facilitate the insertion of the ridges 28 in the recesses 30. During mounting of the plate heat exchanger 1 the heat transfer plates 2, the plane plates 12 and the bent plates 24 are tightened against each other by means of a tightening member or press. Thereafter, the joining members 26 are screwed to the bent plates 24 by the screws 26. Thereby, the joining members 26 may be preheated in such a way that a pretensioning of the plates 24 is obtained when the joining members cool down. The plates 24 may be shaped to extend along the whole length of the plate heat exchanger 1 in the longitudinal direction X or be divided in several pairs, which may be equally distributed along the length of the heat exchanger 1 in the longitudinal direction X.

The present invention is not limited to the embodiments disclosed but may be modified and varied within the scope of the appended claims.

The compressing member may be shaped in further alternative manners. For instance, it may be formed of a plate which preferably is divided in two parts and which may extend along the whole length X of the plate heat exchanger 1 and be bent around each end piece 3 and 4. The end pieces 3 and 4 are compressed together with the outer plates against each other in a suitable tightening device, in such a way that the end edges of the plates abut each other. Thereafter, these end edges are joined together by means of a suitable method such as welding.

Instead of a compressing member comprising a pair of bolts 18 mutually connected to a loop by means of the nuts 19, the compressing member may comprise one bolt extending in a loop around the end pieces 3, 4 and the stack of heat transfer plates 2. In this case the ends of said one bolt are connected to each other by one nut 19 having one left-handed thread and one right-handed thread, in such a manner that the bolt is closely abutting the curved outer surfaces of the end pieces 3, 4.

Furthermore, the compressing member may be formed of one or several bands being extended around the plate heat exchanger 1. Such bands may be applied by means of a tightening device which tightens the band around the plate heat exchanger 1 and deforms the material in both ends of the band in such a way that the ends are fixed to each other. As in the case with the plate-shaped compressing member, it may be advantageous to provide two bands provided in pairs, each band extending around a respective end piece 3, 4 and being tightened at each side of the plate heat exchanger 1. In such a way one may prevent different tightening forces at each side of the plate heat exchanger due to friction.

It should be noted that the compressing members 11, 18, 24 may be provided to extend around the plate heat exchanger 1 at only one or several locations in order to strengthen relatively weak portions, such as the area around the inlet and outlet means 5, respectively.

Each end piece may comprise a plane plate abutting the heat transfer plates 2 and a curved plate being fixed to the plane plate and forming the curved outer surface abutted by the wire, the bands, the bolts etc. In order to increase the strength with respect to pressure forces and prevent that the curved plate is deformed, a means resisting pressure forces may be provided between the plane plate and the curved plate. One such means may for instance be a liquid, support beams or concrete.

What is claimed is:

1. A plate heat exchanger (1) comprising a stack of heat transfer plates (2) provided between two end pieces (3, 4) and each having an essentially plane extension, each end piece (3, 4) having an inner surface facing said heat transfer plates (2) and an outer surface (10, 14, 22) facing away from said heat transfer plates (2) and extending from one side to another of the end piece (3, 4), the plate heat exchanger (1) being compressed by means of at least one member (11, 18, 24) extending around the end pieces and the heat transfer plates in such a manner that said member abuts said outer surface (10, 14, 22) of each end piece (3, 4) in order to prevent the retreat of the end pieces from each other, wherein said outer surface (10, 14, 22) of each end piece (3, 4) is continuously curved from said one side to another in such a manner that the end piece has a convex shape in a cross-section along a first plane (Y, Z) crossing said sides and being perpendicular to the essentially plane extension of the heat transfer plates (2) and the curved outer surface (10, 14, 22) in the proximity of an edge between said inner surface (9) and said outer surface (10, 14, 22) is shaped in such a manner that a tangential plane (X, Y) of said outer surface is essentially perpendicular to the essentially plane extension of the heat transfer plate (2).

2. The plate heat exchanger according to claim 1, wherein that the compressing member (11, 18, 24) comprises joining means (19, 26) provided to releasably tighten the compressing member around the end pieces (3, 4) and the heat transfer plates (2).

3. The plate heat exchanger according to claim 2, wherein that said joining means (19) is provided to enable adjustment of the compressing force of the compressing member (18).

4. The plate heat exchanger according to any claim 1, wherein the compressing member (11, 18, 24) comprises at least one wire-, bar-, band- or plate-like member extending around the end pieces (3, 4) and the heat transfer plates (2).

5. The plate heat exchanger according to claim 1, wherein the compressing member comprises at least one bolt (18) extending in a loop in such a manner that it is closely abutting at least one of the curved outer surfaces of the end pieces (3, 4).

6. The plate heat exchanger according to claim 5, wherein the compressing member comprises at least a pair of said bolts (18) mutually connected to a loop and being curved in such a way that they are closely abutting the curved outer surfaces (14) of the respective end pieces (3, 4) in a common plane.

7. The plate heat exchanger according to claim 2, wherein said joining means comprises a nut (19) having a right-handed thread and a left-handed thread and being screwed onto opposite bolt ends.

8. The plate heat exchanger according to claim 1, wherein the compressing member comprises a wire (11) being wound in a helical coil about the end pieces (3, 4) and the heat transfer plates (2).

9. The plate heat exchanger according to claim 8, wherein the helical wire coil is wound in such a manner that each round of the wire (11) is abutting the adjoining wire round.

10. The plate heat exchanger according to claim 1, wherein the compressing member comprises a plate (24) extending around the end pieces (3) and the heat transfer plates (2).

11. The plate heat exchanger according to claim 10, wherein said compressing plate (24) is divided into two parts, each part extending around a respective end piece (3) in such a way that each end edge of one part is adjacent to an end edge of the other part, and wherein adjacent end edges of said parts (24) are joined to each other by joining means.

12. The plate heat exchanger according to claim 1, wherein each end piece (3, 4) comprises a plane plate (12) forming said inner surface (9).

13. The plate heat exchanger according to claim 12, wherein each end piece (3, 4) comprises a support plate (13, 21) disposed on the plane plate (12) and having a curved edge surface (14, 22).

14. The plate heat exchanger according to claim 13, wherein the support plate (13, 21) extends essentially perpendicularly to the plane plate (12).

15. The plate heat exchanger according to claim 14, wherein several support plates (13) are provided spaced from each other and that a further support plate (15) extends essentially perpendicular to the support plate (13) in order to support the support plates (13) in lateral direction.

16. The plate heat exchanger according to claim 1, wherein said convex shape is essentially semicircular.

17. The plate heat exchanger according to claim 1, wherein said compressing member (11, 18, 24) extends around the plate heat exchanger (1) in a circumferential direction lying in a plane (Y, Z) being perpendicular to the essentially plane extension of the heat transfer plates (2).

* * * * *

UNITED STATES PATENT AND TRADEMARK OFFICE
CERTIFICATE OF CORRECTION

PATENT NO. : 6,098,701

DATED : AUGUST 8, 2000

INVENTOR(S) : RALF BLOMGREN

It is certified that error appears in the above-identified patent and that said Letters Patent is hereby corrected as shown below:

Col. 8, line 1, delete --any--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*